US005618028A

United States Patent [19]

Hepworth

[11] Patent Number: 5,618,028

[45] Date of Patent: Apr. 8, 1997

[54] POWER TOOL ADAPTER

[75] Inventor: Paul S. Hepworth, Guildford, United Kingdom

[73] Assignee: Turner Intellectual Property Limited, United Kingdom

[21] Appl. No.: 278,061

[22] Filed: Jul. 20, 1994

Related U.S. Application Data

[62] Division of PCT/GB93/00079, Jan. 15, 1993.

[30] Foreign Application Priority Data

Jan. 24, 1992 [GB] United Kingdom ..... 9201600

[51] Int. Cl.[6] ..... B24B 41/00

[52] U.S. Cl. ..... 451/375; 451/378; 451/386; 451/406; 451/420

[58] Field of Search ..... 451/359, 424, 451/364, 365, 367, 374, 375, 378, 379, 386, 406, 409, 415, 420

[56] References Cited

U.S. PATENT DOCUMENTS

| | | | |
|---|---|---|---|
| 3,178,857 | 4/1965 | Grob et al. | 451/375 |
| 3,340,651 | 9/1967 | Ahlström | 451/375 |
| 3,599,302 | 8/1971 | Dudek | 29/26 |
| 3,694,967 | 10/1972 | Stielper | 457/375 |
| 3,742,652 | 7/1973 | Enders | 451/375 |
| 3,930,342 | 1/1976 | Moores et al. | 451/375 |
| 4,050,003 | 9/1977 | Owings et al. | 302/2 |
| 4,176,499 | 12/1979 | Mazoff . | |
| 4,269,075 | 5/1981 | Crist et al. | 74/16 |

FOREIGN PATENT DOCUMENTS

| | | |
|---|---|---|
| 2107327 | 5/1972 | France . |
| 2310835 | 12/1976 | France . |
| 2615774 | 12/1988 | France . |
| 3128501 | 2/1983 | Germany . |
| 0543094 | 2/1942 | United Kingdom . |
| 1233340 | 5/1971 | United Kingdom . |
| 1526169 | 9/1978 | United Kingdom . |
| 2132518 | 7/1984 | United Kingdom . |
| WO82/02507 | 8/1992 | WIPO . |

*Primary Examiner*—Timothy V. Eley
*Attorney, Agent, or Firm*—R. Gale Rhodes, Jr.

[57] ABSTRACT

An adapter (12) is of channel shape having longitudinal projections (25) at its respective sides for engagement with undercut grooves (24) in a face of a casing of a powered grinding tool (10) with which the adapter is intended to be fitter to sharpen high speed drill fits, in use, by means of a grinding wheel (20) of the tool. The adapter has a rearwardly directed head (76) at its top, the head having a rotatable dial (85) mounted therein which is provided with a multiplicity of differently sized drill bit receiving openings (87), so that, in use, by angularly moving the dial, the opening for a particular size of drill bit can be brought to a location where the drill bit can be inserted in the hole and correctly worked by the grinding wheel, when the adapted is fitted to the tool.

7 Claims, 4 Drawing Sheets

POWER TOOL ADAPTER

CROSS-REFERENCE TO RELATED APPLICATION

This application is a division of PCT GB93/00079, filed on 15 Jan. 1993, which was pending on 20 Jul. 1994.

BACKGROUND OF THE INVENTION

This invention relates to an adapter which is intended to be fitted to a powered grinding tool, the tool being primarily for use in the sharpening, smoothing, cutting, abrading, honing etc., of implements, such as drill bits, scissors, knives, chisels, planar blades and the like.

Whilst attachments for an electric drill are known which can carry out one or more of the various operations referred to above, their major disadvantage is of course that the drill cannot be used for its intended purpose whilst the attachment is fitted.

SUMMARY OF THE INVENTION

An object of the invention is to provide an adapter for a powered grinding tool in an efficient and convenient manner.

According to the invention there is provided an adapter for releasable engagement with a powered grinding tool having a casing, a motor adapted to be driven by power supply means, a rotatable shaft drivable, in use, by the motor, and a rotatable grinding wheel to which drive is transmitted in use, from said shaft, the adapter being characterized by having engagement means for it to be automatically secured to said casing at a work station of the tool, in use, and to be removed therefrom subsequently, and defining a location which, when the adapter is fitted to said tool at said work station thereof, in use, provides for correct positioning between part of an implement at said location and said grinding wheel for said part to be worked by the wheel when it is driven, in use, by a top portion in the form of a head angled rearwardly relative to a lower portion, said head having an opening at which said grinding wheel is disposed when the adapter is secured to said casing at said work station, in use, and by the head mounting a drill bit positioning member for providing said location.

DESCRIPTION OF THE DRAWINGS

The invention will now be described, by way of example, with reference to the accompanying drawings, in which.

DESCRIPTION OF THE PREFERRED EMBODIMENT

The invention relates to an adapter for use with a powered grinding tool which has a work station at which a selected one of several adapters designed for use with the tool can be releasably fitted, the tool having a casing to which, in the disclosed embodiment, two further adapters can be releasably stored when not fitted at the work station. The casing could be differently arranged to store only one or more than two adapters.

The tool is powered from the mains electricity supply or could have a rechargeable or renewable battery as its power source. The tool has a motor in its casing driving a rotatable shaft on which is carried a grinding wheel at the work station. When fitted at the work station, each adapter provides a location correctly disposed relative to the grinding wheel for part, usually an end, of an implement, to be worked on by the wheel, to be inserted into or onto the location for said working by the wheel. By means of some manual manipulation of the implement in this position, the correct working can be effected.

The tool is advantageous in having its own motor so that it is not an attachment and does not rely on power from a separate tool, such an electric drill. Moreover it is easy to use, allows quick and easy changes of adapters for use with different implements, and conveniently provides storage for adapters not in use, ensuring that when stored they are always at hand and do not become lost.

Figure 1:
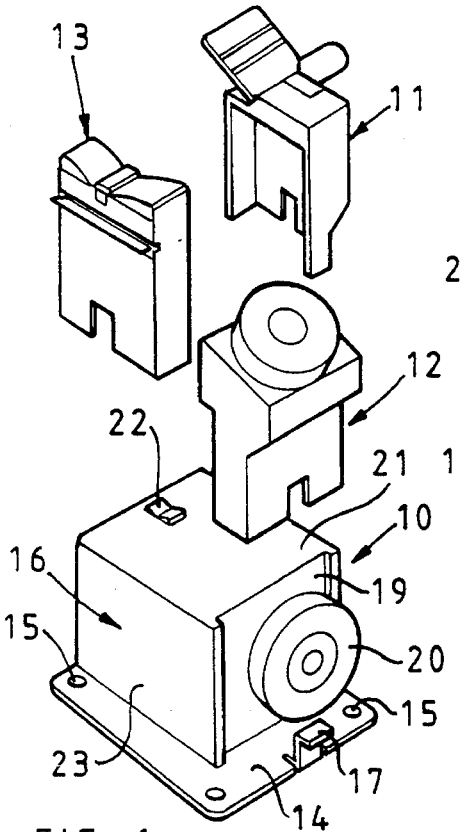
FIG. 1 is an exploded, schematic perspective view showing a powered grinding tool together with an adapter of the invention as well as two other adapters, for use with and storage at the tool.
Figure 2:
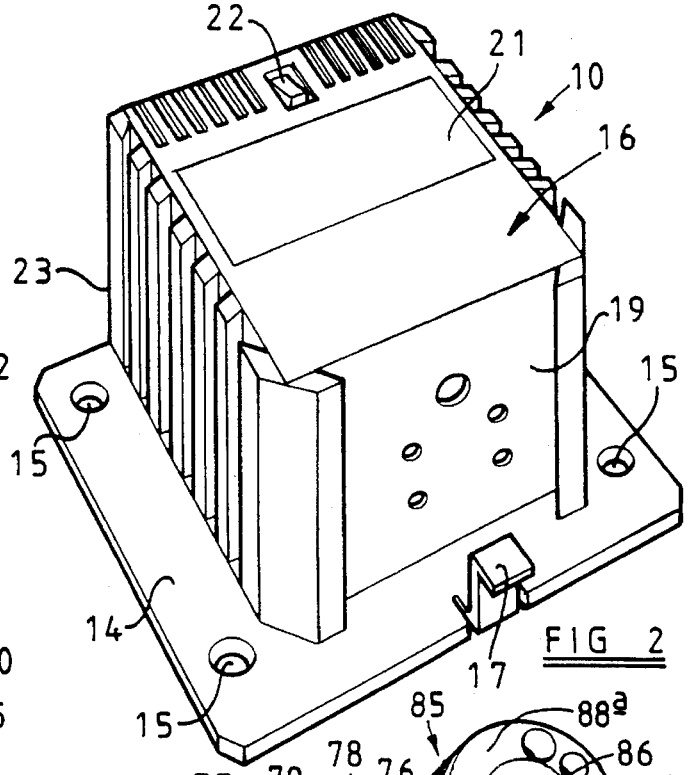
FIG. 2 is a front perspective view of the tool, with a grinding wheel thereof not shown.

FIG. 1 schematically shows the tool 10 with generally three plastics material adapters 11, 12 and 13 respectively, the adapter 12 forming the subject of the invention. The tool has a rectangular plastics material base 14 with screw holes 15 for securing it to a workbench or other surface. Snap-fittingly engaged with the base is a rectangular plastics material casing 16. Adjacent one of its edges the base has on its upper surface an upstanding, hinged, flexible catch 17, which in use is intended to be manually pressed downward and outward when fitting or removing an adapter to the tool. As will be described, the catch 17 has a inwardly directed projection 18 (FIGS. 4 and 5) facing the tool casing for releasable snap-fit engagement with a front face of each adapter to retain it in place, in use.

Figure 8:
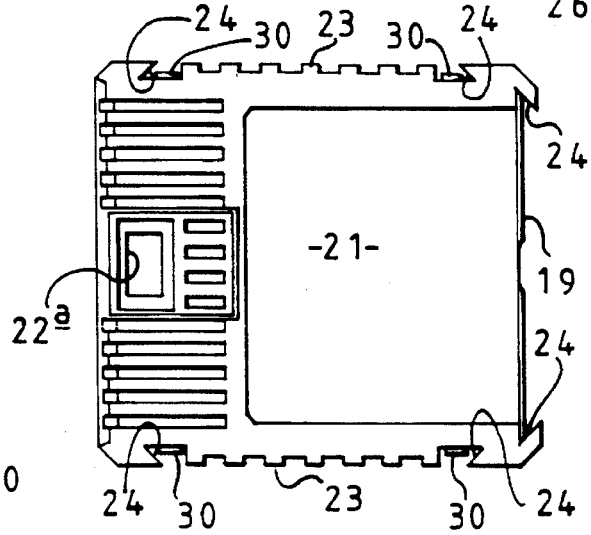
Figure 10:
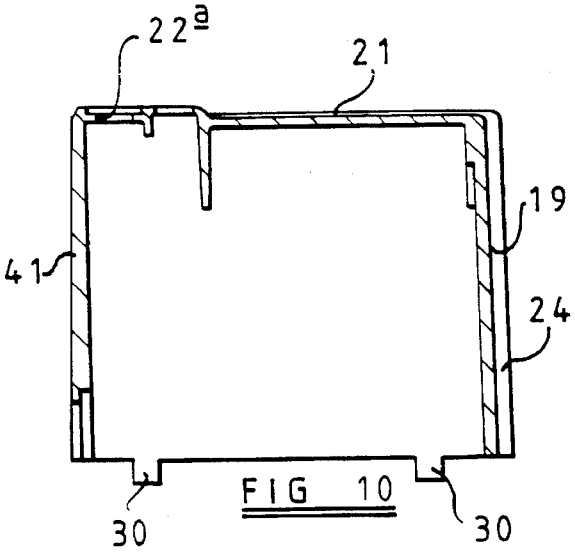
FIG. 10 is a vertical section through the casing.
Figure 12:
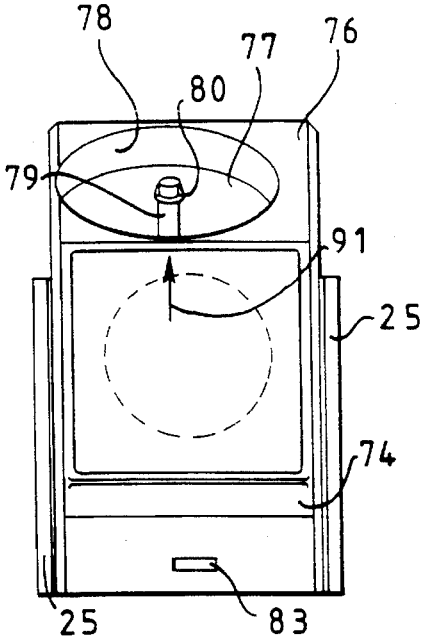
FIGS. 12 and 13 are respectively a front view and a side view of part of the adapter of FIG. 3.
Figure 11:
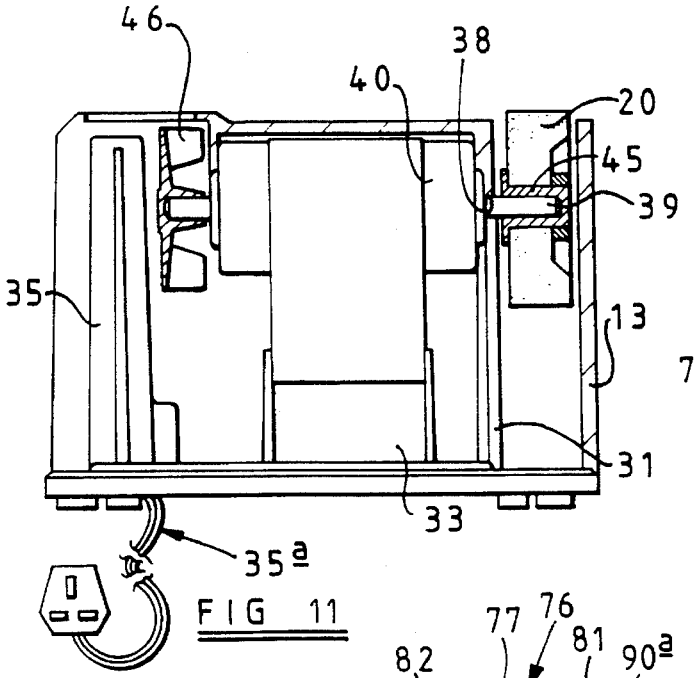
FIG. 11 is a diagrammatic view of part of the inside of the tool showing a motor, fan grinding wheel and power supply means of the tool.
Figure 13:
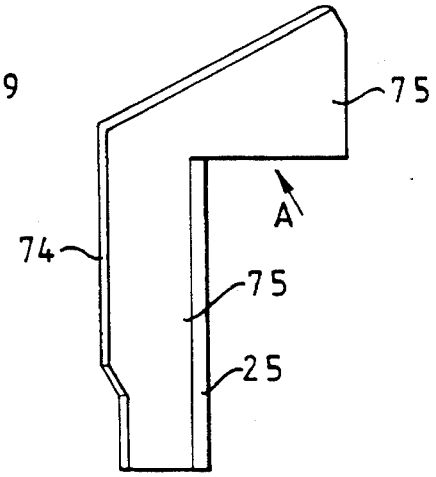
Figure 14:
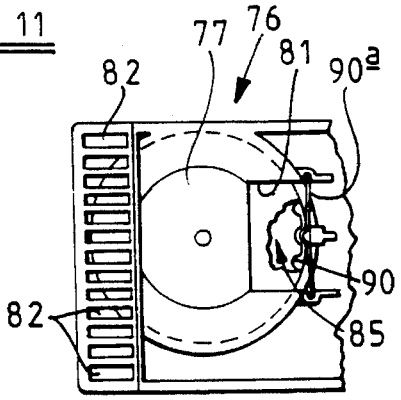
FIG. 14 is a fragmentary view on arrow A of FIG. 13, also showing schematically how an indexing spring engages a dial of the adapter.

The catch 17 is spaced from a front surface 19 of the casing, at which is arranged a grinding wheel 20, for example of aluminium oxide, so as to define the work station of the tool. The outer surface of the wheel could be flat, or provided with a central annular recess, as shown in FIG. 11. The upper surface 21 of the casing receives an on-off rocker switch 22 for controlling electrical power to the tool, whilst both casing side surfaces 23 are formed as storage areas for respective adapters. As schematically shown in FIG. 1, and more clearly shown for adapter 12 in FIGS. 3 and 12 to 15, each adapter has its longitudinal side edges formed for complementary sliding engagement with respective undercut grooves 24 at opposite ends of both the front surface 19 and also the two side surfaces 23. As shown in FIG. 8, the grooves in this example are half of a dove-tail groove and the two complementary half dove-tail projections 25 are shown for adapter 12 in FIGS. 3 and 12 to 15. Accordingly any one adapter can engagingly be slid down the front of the tool at the work station and fixed by said catch 17, or can engagingly be slid down either side of the tool to be stored thereat.

Shown in FIG. 1 are three adapters, each for use with different forms of implement. Adapter 11 is for use with sharpening chisels and planes, adapter 12 is for sharpening high speed drill bits, whilst adapter 13 is for sharpening knives and scissors. As explained above all have projections 25 at their respective opposite longitudinal edges.

Figure 4:
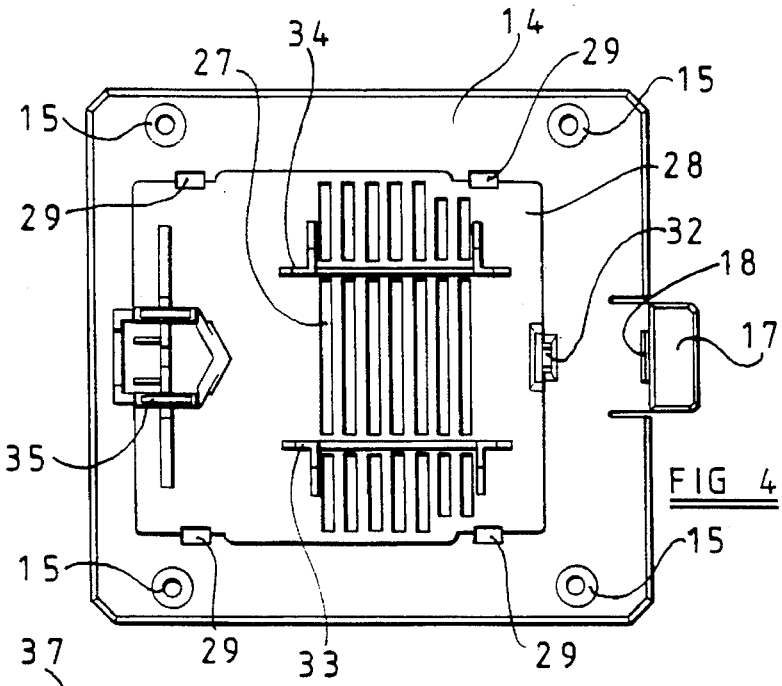
FIG. 4 is a top plan view of a base of a casing of the tool.
Figure 5:
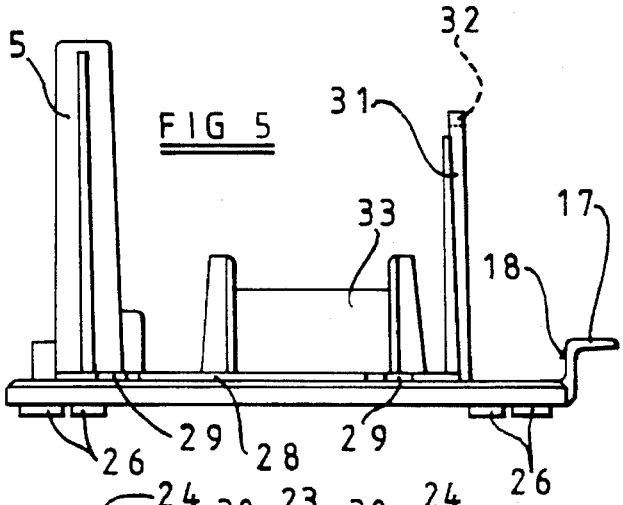
FIG. 5 is a side view of the casing base of FIG. 4.

FIGS. 4 and 5 show the base 14 of the tool. The base has support feet 26 on its underside and is formed with central slots 27 through a central slightly raised rectangular area 28 onto which the casing 16 is fitted on assembly. Adjacent the four corners of the area 28 on two sides thereof are latch openings 29 for snap-fittingly receiving flexible latches 30 complementarily arranged at the bottom of the grooves 24 of the casing, as shown in FIGS. 6, 7, 9 and 10.

Upstanding from a front edge of the area 28 at the centre thereof is an integral tapered finger 31 which has a semi-circular recess 32 in its top surface. Upstanding integrally from the centre of the area 28 at opposite longitudinal ends respectively of an inner set of the slots 27 are support ribs 33, 34. Upstanding integrally from just inside a rear edge of the area 28 at the centre thereof is a guide structure 35.

Figure 6:
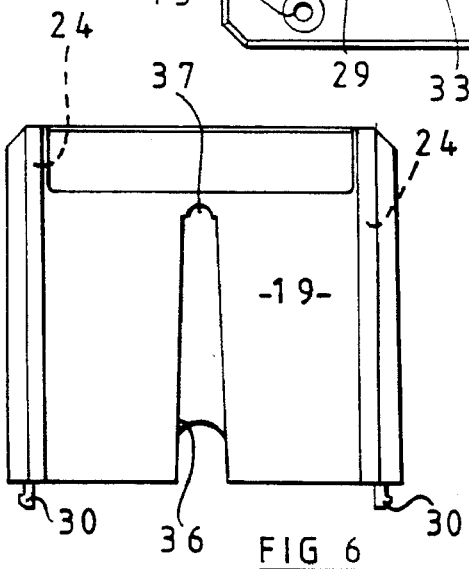
FIG. 6 is a front view of the casing, in a form different from FIG. 2.

The casing is shown in FIGS. 6 to 10. FIG. 6 shows the front surface 19 having the longitudinal half dove-tail, undercut grooves 24 along its sides and the latches 30 thereunder. In its centre it has a tapering opening 36 which is generally complementary to and able to slide over and engage on the finger 31. However the top of the finger 31 remains spaced slightly below the inner top surface 37 of the opening which is semi-circular and with the recess 32 defines a circular opening 38 for a drive shaft 39 of a 220 V A.C. motor 40 of the tool, as shown in FIG. 11.

Figure 7:
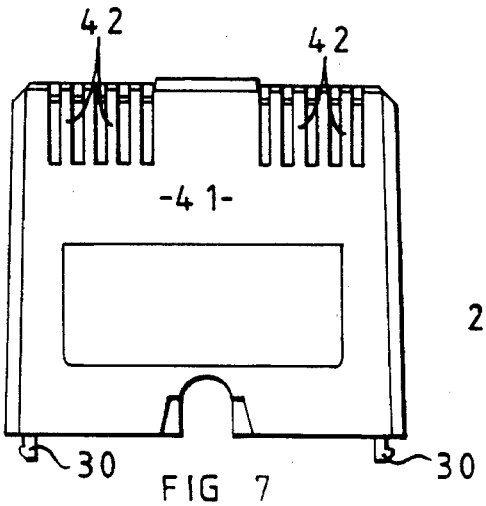

FIG. 7 shows the rear surface of the casing, denoted by numeral 41, this having open slots 42 at its upper edge, these slots continuing into the upper surface 21 of the casing (FIG. 8) at opposite sides of an opening **22*a* for the switch 22**.

Figure 9:
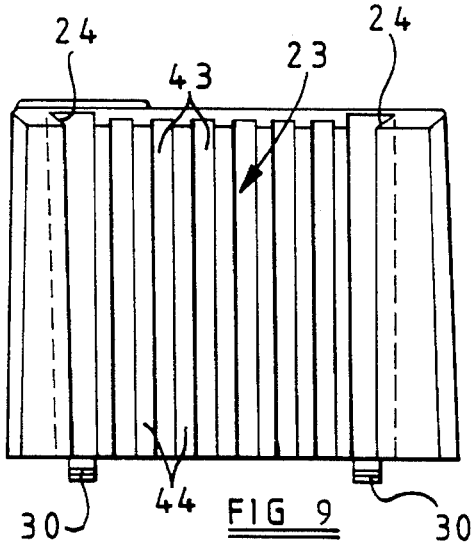
FIGS. 7 to 9 are respectively a rear view, a top view and a side view of the casing.

Each of the side surfaces 23 of the cases has said grooves 24 respectively at its opposite ends as shown in FIGS. 8 and 9, whilst between the grooves are a series of parallel upright ribs 43 separated by parallel grooves 44, the ribs and grooves each having a generally rectangular cross-section.

FIG. 11 shows the motor 40, carried in the casing by means including the support ribs 33, 34, and held both axially and radially. In this embodiment the drive shaft 39 is in permanent, direct drivable engagement with the motor, but alternatively the engagement could be through gearing. The end of the shaft projects through opening 38 to terminate outside of the casing front surface 19 where it carries a plastics material collar 45 with a left hand thread, on which collar is the grinding wheel 20, driven, in use, directly, as shown, or alternatively indirectly, by the motor 40 and shaft 39, and secured in place by an end nut. When an adapter 11, 12 or 13 is fitted at this work station defined at the wheel 20, it substantially shrouds the wheel, which is itself received in a channel part of the adapter, as schematically shown for adapter 13 in FIG. 11. At the rear end of the shaft 39, which protrudes from the motor, a plastics material fan 46 is carried thereon so as to be driven by rotation of the shaft, in use, to effect cooling of the interior of the casing.

As will be appreciated from the foregoing description of the base 14 and casing 16, the casing can be snap-fittingly engaged with the base merely by correctly relatively positioning the latches 30 and latch openings 29 and then forcing the components together. Once engaged together, wires **35*a* supplying electrical power for the motor pass up through the guide structure 35 for co-operation with the switch 22**, which is itself arranged to control the motor.

Having now described the body of the tool, the adapter 12 of the invention, already briefly referred to will now be more fully described.

Figure 3:
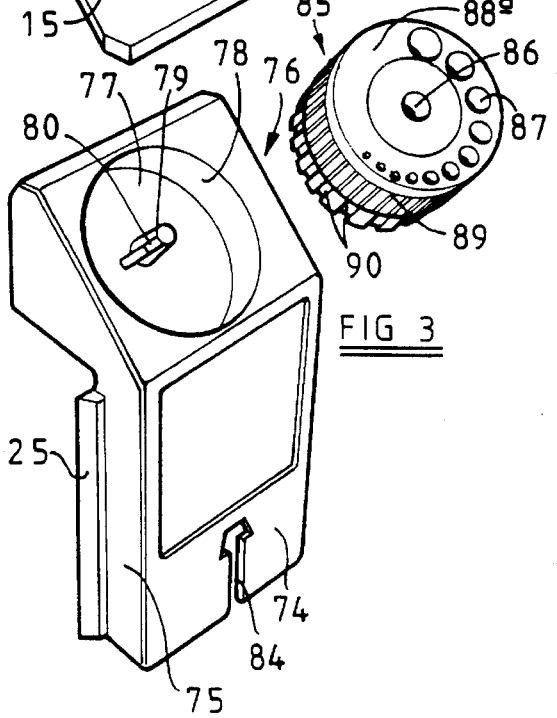
FIG. 3 is an exploded perspective view of the adapter of the invention intended for use in sharpening high speed drill bits.
Figure 15:
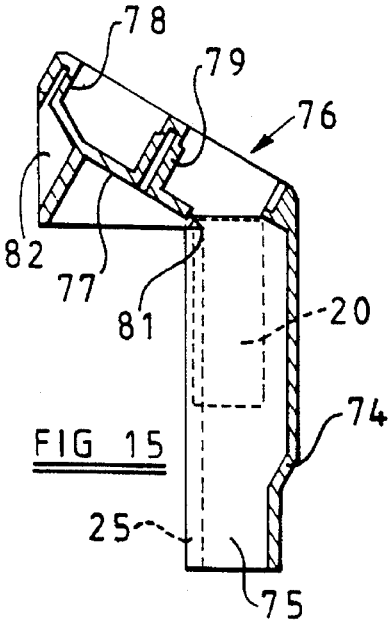
FIG. 15 is a sectional side view of the part of the adapter in FIG. 12.
Figure 16:
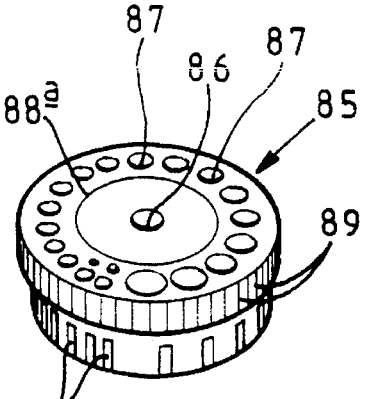
FIG. 16 is a top perspective view of a selector dial of the adapter of FIG. 3.
Figure 18:
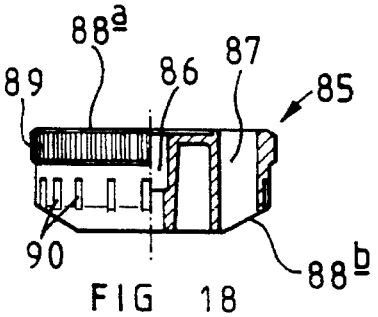
FIG. 18 is a part-sectional side view of the dial.
Figure 17:
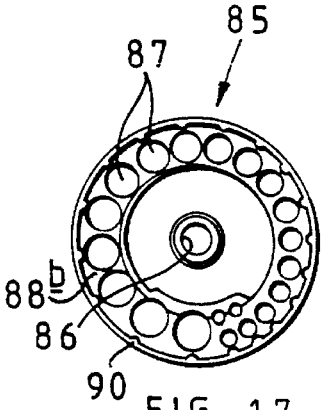
FIG. 17 is an underneath view of the dial.
Figure 19:
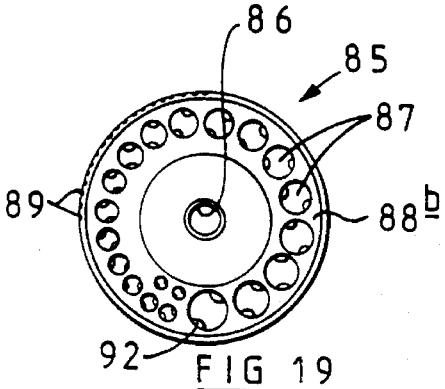
FIG. 19 is a detailed top view of the dial.

The adapter 12 has a lower channel-shaped part with a stepped base 74 and parallel sides 75 which have the projections 25 along their longitudinal edges. The top of the adapter 12 is in the form of a head 76 at a rearwards angle to its lower channel-part. The head provides therein an upwardly open cylindrical chamber having a bottom wall 77 and a cylindrical side wall 78. At the axis of the cylinder is an upstanding spigot 79 having barbs 80 at its free end. Where the head joins the channel-shaped part of the adapter a portion of the wall 77 is removed to provide an opening 81. In use with the adapter 12 fitted on the casing at the work station, the wheel 20 is disposed level with the bottom of opening 81, as shown in FIG. 15. The outer, uppermost part of the head is, at its underside, formed with a row of slots 82. In its base 74, the adapter has a central rearwardly closed rectangular recess 83 near its lowermost edge, for engaging the catch projection 18 releasably to lock the adapter to the tool at the work station, in use. Alternatively the location for snap-fittingly engaging the projection 18 can be an arrow-shaped slot 84 (FIG. 3). It will be noted that, as viewed in FIG. 12, the axis of the spigot 79 is off-set relative to a central longitudinal plane of the channel-shaped lower part.

Fitted in the chamber in the head 76 is a selection means in the form of an angularly moveable, cylindrical dial 85. The dial has a central counter-bored hole 86 therethrough to receive the spigot 79 therein, with the barbs 80 ensuring the dial 85 remains on spigot 79, once initially engaged therewith, for rotational movement thereon.

Around the periphery of its outer face, the dial has a series of equi-spaced circular holes 87 therein, the axis of each of which is parallel to the axis of hole 86 and extends through the thickness of the dial from an outer surface **88*a* to an inner surface 88*b***. The diameters of the respective holes decrease steadily in an anti-clockwise direction around the series, and at the end thereof the smallest two holes are, in this embodiment, arranged inwards of a slightly larger diameter pair forming the next largest of the series, so as to have two holes on a radius. All other holes are singly on a radius from the centre of the dial. The twenty holes, for example, cater for sizes of high speed drill bits from 10 to 3.1 in this embodiment.

The exterior surface of the dial adjacent its outer or top surface **88*a* is formed with knurling 89 to allow it to be gripped and angularly moved about spigot 79. There is then a slight external step leading to a series of parallel, concave grooves 90 around the dial. One of these is normally engaged by an end of a blade spring 90***a* (FIG. 14) between the dial and the head so as to provide a positive releasable lock of the dial when in a selected, stepwise adjusted, i.e. indexed position, as will be described. The lower part of the exterior of the dial is of frusto-conical form as shown in FIG. 29.

Accordingly, in use, with the adapter engaged on the tool at the work station, the wheel 20 is disposed as shown in FIG. 15, and the dial can be moved stepwise angularly until a correctly sized hole 87 is aligned with an indication 91 on the front surface of the adapter. The positioning of the dial on the spigot 79 will ensure that in all the positive, stepwise adjusted positions of the dial, a radius thereof, with one or two holes therealong, will be aligned with the indication 91. In this position the end of a drill bit can be inserted into a hole aligned with indication 91 and this will be worked on by the wheel as it rotates. To ensure correct sharpening the drill can be manually twisted in its hole. Each hole thus correctly locates a drill bit end for being worked on by the wheel when the selected hole is aligned with indication 91.

Figure 20:
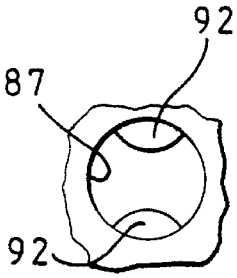
FIGS. 20 and 21 show to an enlarged scale top and sectional sides views respectively of a hole of the dial.
Figure 21:
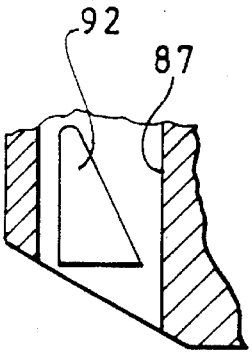

FIGS. 20 and 21 shows means for more positively locating a drill bit end in a hole 87, the means being in the form of opposed ridges 92. As can be seen, each ridge is arcuate in plan and generally triangular at right angles thereto. They are sized for each hole loosely to engage opposed drill bit flutes.

It will be appreciated that further adapters to those disclosed can be sold as part of the tool or as separate add-on components. The three adapters 11, 12 and 13 are considered to provide common implement working requirements and further adapters could be for more specialised use. Further adapters would of course have projections 25 and a lower slot (or equivalent) to engage and lock with the casing and base respectively. Normally the further adapters would be of plastics material.

The adapter 12 is intended to be used, with the wheel 20, for sharpening high speed drill bits, and is not intended to be used with tungsten carbide drill bits, usually masonry or hammer drill bits. For sharpening such drill bits a suitable alternative grinding wheel would be sold, so that the wheel 20 could be removed and replaced by the alternative one. Lawn mower blades and the like could then also be sharpened. Together with such an alternative wheel, an alternative adapter (not shown) could be provided for use therewith.

In an alternative form of the tool 10, the motor could drive a further shaft, like the shaft 39, but which projects from the rear of the casing to define a further work station at which adapters might or might not be engageable. Gearing could be provided in the casing so that the two wheels could operate or be operated at different rotational speeds. The permanent second wheel could be of white stone for honing.

The adapters which provide for utilisation of a grinding wheel accurately position a location for part of an implement to be worked on, when it is engaged at the work station. Moreover each location provides some support for the implement, although it would normally be necessary for the implement to be held during the working by the wheel. Any material ground from the implement during working will fall between the casing front surface and the adapter, to the base, from where it can easily be cleared once the adapter is removed.

Although the part dove-tail slot and projection arrangement disclosed is particularly satisfactory for slidingly engaging an adapter at a work station or a storage position of the casing, any suitable alternative means could be used, even screws or the like.

The grinding wheel of the tool can have a flat or recessed front surface. A recess is more desirable as it accommodates the end of the motor shaft and fixing nut below the front grinding surface. The use of different wheel compositions (grit size and type) is selected to match the tool's typical material. For example tungsten carbide requires what is commonly known as green grit or diamond, whilst with honing, which is usually a finer grinding process, and sometimes used wet, the grit is usually white alumina and of finer grade.

I claim:

1. An adapter for releasable engagement with a powered grinding tool having a casing, a motor adapted to be driven by power supply means, a rotatable shaft drivable by the motor, and a rotatable grinding wheel to which drive is transmitted from said shaft, the adapter being characterized by engagement means for it to be secured to said casing at a work station of the tool and to be removed therefrom subsequently, and defining a location which, when the adapter is fitted to said tool at said work station thereof provides for correct positioning between part of an implement at said location and said grinding wheel for said part to be worked by the wheel when angled rearwardly relative to a lower portion, said head having an opening at which said grinding wheel is disposed when the adapter is secured to said casing at said work station and said head mounting a drill bit positioning member for providing said location, wherein said positioning member is in the form of a rotatable dial mounted for angular movement partly within a cylindrical chamber in the head, the dial having a multiplicity of differently sized drill bit receiving openings therethrough, each of which, by angular movement of the dial into one of a plurality of indexed positions, can provide said location so that with the adapter fitted to said tool at said work station a drill bit at said location can be worked by the wheel.

2. An adapter as claimed in claim 1 wherein the dial is releasably held in each indexed position where a drill bit receiving opening is correctly located relative to the wheel.

3. An adapter as claimed in claim 2, wherein the dial is releasably held in its indexed positions by part of a blade spring engaging in respective grooves in the exterior surface of the dial, the spring being between the dial and said head.

4. An adapter as claimed in any one of claims 1, 2, or 3, wherein at least one drill bit receiving opening has opposed ridges therein to engage opposed drill bit flutes.

5. An adapter as claimed in claim 1, wherein said lower portion extends from said location, the lower portion being of generally channel shape having spaced sides and there being said engagement means at said sides respectively to enable said adapter to be secured, in use, to said casing of the tool to retain the adapter at said work station against lateral movement.

6. An adapter as claimed in claim 5, wherein the lower portion of the adapter has engagement means for releasable inter-engagement with co-operating means at a base of the tool to prevent longitudinal movement of the adapter when it is secured at said work station.

7. An adapter as claimed in claim 5 or claim 6, wherein said means at its sides are projections for engagement with complementary undercut slots at the casing.

* * * * *